United States Patent [19]

Hauschopp

[11] 4,279,445

[45] Jul. 21, 1981

[54] LONGWALL MINING INSTALLATION HAVING STABLE-HOLE PLOUGH

[75] Inventor: Alois Hauschopp, Werne, Fed. Rep. of Germany

[73] Assignee: Gewerkschaft Eisenhutte Westfalia, Lunen, Fed. Rep. of Germany

[21] Appl. No.: 93,831

[22] Filed: Nov. 13, 1979

[30] Foreign Application Priority Data

Nov. 18, 1978 [DE] Fed. Rep. of Germany ..... 2850175

[51] Int. Cl.[3] ..... E21C 27/34

[52] U.S. Cl. ..... 299/34; 299/43

[58] Field of Search ..... 299/32, 34, 43

[56] References Cited

U.S. PATENT DOCUMENTS 4,154,479 5/1979 Braun et al. ..... 299/34

4,180,291 12/1979 Lobbe et al. ..... 299/34

FOREIGN PATENT DOCUMENTS 515663 12/1952 Belgium ..... 299/43

1802265 5/1970 Fed. Rep. of Germany ..... 299/34

*Primary Examiner*—Ernest R. Purser

*Attorney, Agent, or Firm*—Thompson, Birch, Gauthier & Samuels

[57] ABSTRACT

A longwall mineral mining installation has a longwall conveyor, a plough guide attached to the face-side of the conveyor, and a main plough movable to and fro along the guide. A respective stable-hole plough is movable to and fro along portions of the plough guide adjacent to each end of the conveyor. Each stable-hole plough is driven by means of a respective endless drive chain which passes round two end sprockets. One end sprocket of each stable-hole plough is positioned at the face-side of the conveyor part way therealong. The other end sprocket of each stable-hole plough is positioned at the adjacent end of the conveyor on the goaf-side thereof. Each drive chain passes round a direction-changing unit positioned at the adjacent end of the conveyor.

22 Claims, 5 Drawing Figures

LONGWALL MINING INSTALLATION HAVING STABLE-HOLE PLOUGH

BACKGROUND OF THE INVENTION

This invention relates to a longwall mineral mining installation.

A known type of longwall mineral mining installation has a face conveyor which extends along a longwall working. At each end, the working merges with a roadway or gallery which extends substantially at right-angles thereto. A plough guide is attached to the face-side of the conveyor and a plough is movable to and fro along the guide. The plough is driven, via a sword plate extending under the conveyor and a goaf-side endless drive chain attached to the sword plate, by means of a drive situated at one end of the conveyor. Such an installation may also have a second plough which is also movable to and fro along the plough guide. In this case, the two ploughs are independently operable so that the capacity of the face conveyor can be utilised as fully as possible. The use of two ploughs also enables mineral material to be won, from faces having seams of differing hardness or zones containing deformities, at the same rate as that possible using a single plough on faces having uniform, uninterrupted seams. The drives for the two ploughs are arranged one at each end of the conveyor, that is to say in the end zones of the working where the conveyor drives are situated. Consequently, the already constricted end zones of the longwall conveyor are further congested, particularly as both ploughs have to be designed to deal with the same high winning capacity, and so require large and robust drives. Another disadvantage of such an installation, is that the end (stable-hole) zones of the working have to be excavated by hand. Alternatively, if the conveyor were extended so that the ploughs could win material over the entire length of the longwall face, the heavy drives for the conveyor and the ploughs would have to be situated in the roadways, and this is disadvantageous because the roadway roof support systems would have to be opened up each time the conveyor is advanced to follow up the advance of the face. Furthermore, the two ploughs require drive chains and chain guides that extend the entire length of the conveyor, and this involves an extremely expensive construction and makes repair and maintenance work rather difficult. (DE-OS No. 2 439 259 describes such an installation).

In order to obviate the need to excavate the stable-hole regions by hand, another known type of longwall mineral mining installation has an extended face conveyor. The end extensions of the conveyor are curved and terminate in the roadways. The disadvantage of this type of installation is that the roadways are completely filled up with machinery in the access zones to the longwall working. Moreover, when the conveyor is advanced, the roadway roof support systems have to be opened up. (see DE-AS No. 1 280 782).

The aim of the invention is to provide a longwall mineral mining installation that can win material in the stable-hole regions of a longwall working, without leading to excessive machinery congestion in the zones where the working meets the access roadways.

SUMMARY OF THE INVENTION

The present invention provides a longwall mineral mining installation comprising a longwall conveyor, a guide attached to the face-side of the conveyor, a main plough movable to and fro along the guide, and an auxiliary plough movable to and fro along a portion of the guide adjacent to one end of the conveyor, the auxiliary plough being driven by means of an endless drive chain which passes round two end sprockets, wherein one end sprocket is positioned at the face-side of the conveyor part way therealong, the other end sprocket is positioned at said one end of the conveyor on the goaf-side thereof, and the drive chain passes round a direction-changing unit positioned at said one end of the conveyor.

With this installation, the face is worked, over the major part of its length, by the main plough. Preferably, the main plough has a sword plate which extends beneath the conveyor and engages a drive chain housed within a chain guide at the goaf-side of the conveyor. As the main plough drive chain is on the goaf-side of the conveyor, it is readily accessible. As the auxiliary (stable-hole) plough only wins material in the end zone of the face, it can be a relatively low-performance plough. Moreover, the working ranges of the two ploughs can overlap, since they move on the same guide. However, since the auxiliary plough operates over only a relatively short distance, it can be driven by a relatively short drive chain. Consequently, there is no need for the auxiliary plough to be provided with a drive chain that extends the entire length of the conveyor. This is particularly important in relatively thin seams where it is difficult to get at such a drive chain for the purposes of repair and maintenance. The short length of the auxiliary plough drive chain also leads to a reduction in construction costs.

The drive chain of the main plough may be powered by a main drive positioned adjacent said one end of the conveyor. Advantageously, the drive chain of the auxiliary plough is powered by means of an auxiliary drive positioned adjacent said one end of the conveyor. Preferably, the main drive, the conveyor drive and the auxiliary drive form a composite unit. Moreover, the auxiliary drive may be off-set towards the goaf-side of the conveyor with respect to the main drive and the conveyor drive. Thus, the entire drive system, together with the drive frame at the end of the conveyor, can be located at the end of the longwall working adjacent to the roadway. This means that the entire system can be advanced without opening up the roadway roof support system.

Advantageously, the auxiliary drive drives said other end sprocket, said one end sprocket being an idler sprocket. Alternatively, the auxiliary drive drives said one end sprocket, said other end sprocket being an idler sprocket.

In one preferred embodiment, the direction-changing unit is constituted by a pair of vertically-spaced, pulley wheels rotatably mounted on a common vertical shaft. Alternatively, the direction-changing unit is constituted by a curved extension of the guide. In either case, the direction-changing unit may be mounted on a drive frame situated at said one end of the conveyor. In this latter case, the main drive and the conveyor drive may be attached to the drive frame, and the auxiliary drive may be attached to the support.

Advantageously, the guide is constituted by a plurality of guide sections. Preferably, the guide sections which constitute said portion of the guide are each provided with a pair of vertically-spaced chain ducts which house the drive chain of the auxiliary plough.

Said one end sprocket may be housed within a pocket in the guide, the pocket being defined by recesses formed in a pair of adjacent guide sections. Each guide section may be a solid plate.

BRIEF DESCRIPTION OF DRAWINGS

Two forms of mineral mining installations, each constructed in accordance with the invention, will now be described, by way of example, with reference to the accompanying drawings, in which.

DESCRIPTION OF PREFERRED EMBODIMENT

Figure 1:
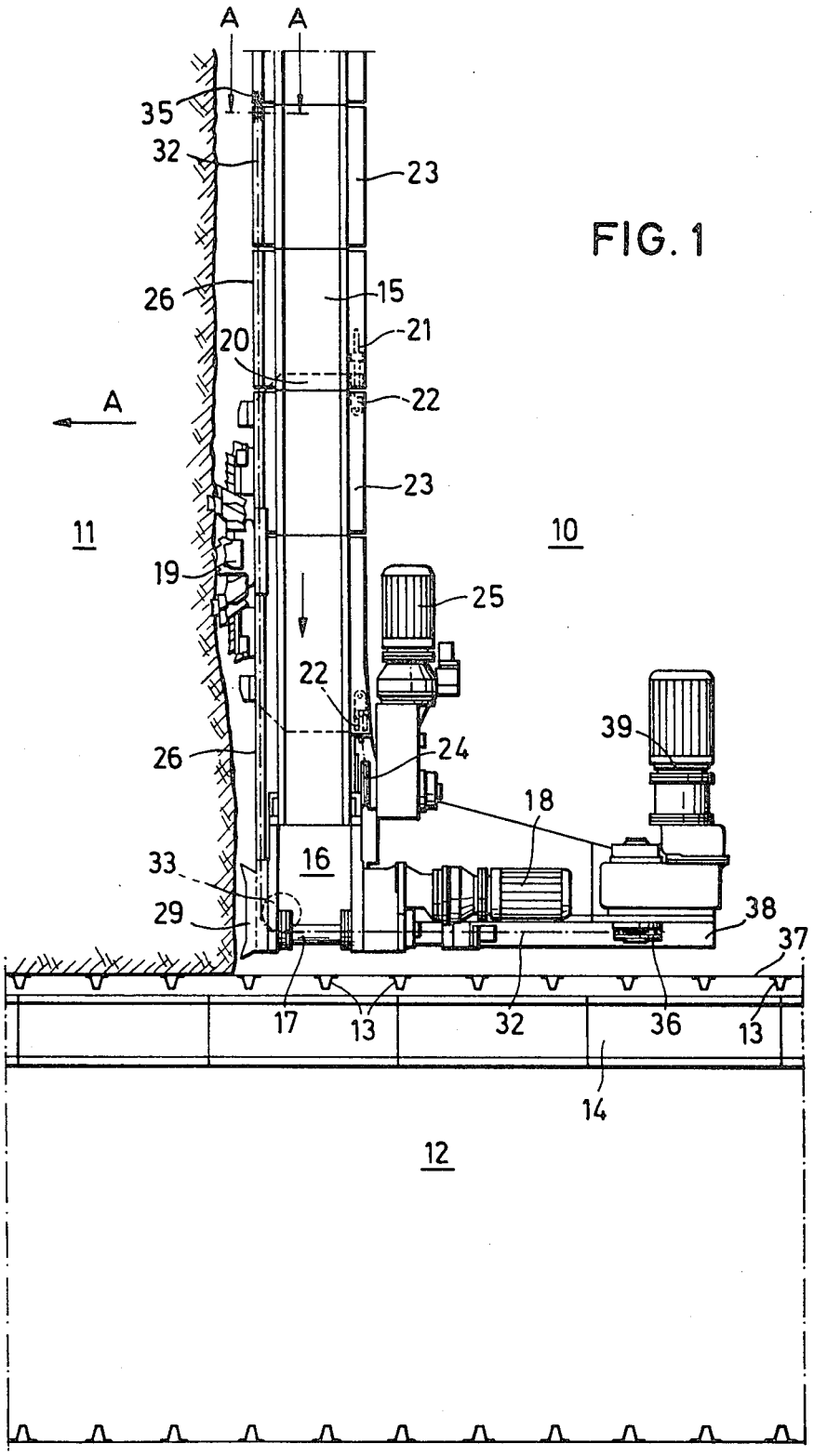
FIG. 1 is a plan view of the first form of installation, and shows the region where a longwall working meets a roadway or gallery.

Referring to the drawings, FIG. 1 shows a longwall working 10 having a face 11, and a roadway or gallery 12 whose roof is supported by arch members 13. A scraper-chain conveyor 14 is provided in the roadway 12 for removing mineral material(such as coal) won from the face 11 and transported thereto by a scraper chain conveyor 15 which extends along the working 10. The scraper-chain conveyor 15 can be advanced, in a known manner, in steps in the direction of the arrow A to follow up the advance of the face 11. The scraper-chain conveyor 15 is made from a plurality of channel sections which are joined together end-to-end in such a manner as to permit limited articulation between individual channel sections. Each end of the face conveyor 15 is provided with a drive frame 16 (only one of which can be seen in the drawings). Each drive frame 16 has a drive drum 17 for driving the endless chain (or chains) of the face conveyor 15. The drum 17 is powered by a drive 18 constituted by a motor, a gear unit and a clutch. The drive 18 is situated at the goaf-side of the face conveyor 15 and is secured to the drive frame 16 by flanging.

The main coal winning is carried out by a main plough 19 which is driven to and fro along the face-side of the face conveyor 15 by means of an endless chain 21 situated at the goaf-side of the conveyor, the plough being connected to the chain by means of a sword plate 20 which extends below the conveyor. The sword plate 20 is attached, at 22, to the plough drive chain 21. The two runs of the plough drive chain 21 are housed in chain ducts provided in cover plates 23 attached to the goaf-side of the face conveyor 15. The cover plates 23 are of the same length as the channel sections of the face conveyor 15, and each cover plate is attached to one of the channel sections. At each end, the plough drive chain 21 passes round a sprocket 24 (only one of which is shown), each of which is driven by means of a drive 25 (only one of which—the main drive—is shown, the other drive—the auxiliary drive—being positioned at the opposite end of the face conveyor 15). It is possible to dispense with the auxiliary drive, in which case the sprocket 24 at the opposite end of the face conveyor 15 merely serves to direct the chain from one run to the other. Each of the plough drives 25 is secured, by flanging, to the goaf-side of the respective drive frame 16 or to an intermediate channel section which connects that drive frame to the adjacent end channel section of the face conveyor 15.

Sword plough installations of this kind are well known. Each of the drive frames 16 of the face conveyor 15 does not extend into its roadway 12, but terminates immediately in front of the arch members 13 which support that roadway. Won coal is delivered to the roadway conveyor 14 via the drive drum 17 and a chute (not shown).

A plough guide 26 is built on the face-side of the face conveyor 15, the plough guide extending the entire length of the face conveyor. The plough guide 26 is made of individual sections 27, whose length corresponds to that of the channel sections of the face conveyor 15. The guide sections 27 are joined together end-to-end for limited articulation. The main plough 19 is supported on, and guided along, the plough guide 26.

Figure 3:
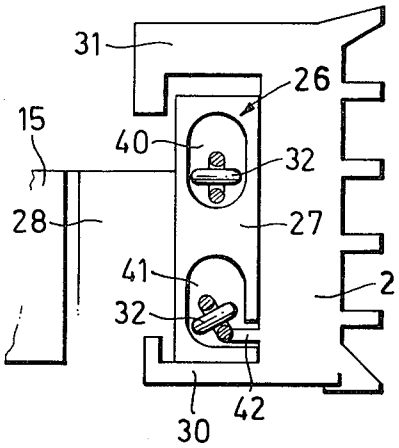
FIG. 3 is a schematic transverse cross-section of the face-side plough guide of the installation of FIGS. 1 and 2.

As can best be seen from FIG. 3, the guide sections 27 are connected to the face conveyor 15 by means of spacers 28. The plough guide 26 supports and guides a stable-hold plough 29 as well as the main plough 19. The stable-hole plough 29 engages the plough guide 26 by means of hook-shaped guide members 30 and 31. As is usual, the stable-hole plough 29 is used to win coal in the end (stable-hole) region of the face 11 and create space for accommodating the drives 25 and 18 for the main plough 19 and the face conveyor 15. The stable-hole plough 29 is swordless, and is provided with its own drive 39 which drives the plough 29 using an endless plough drive chain 32 via a drive sprocket 36, a pair of pulley wheels 33 and an idler sprocket 35. The pulley wheels 33 are positioned in the drive frame 16 at the junction between the face conveyor 15 and the roadway conveyor 14, and the idler sprocket 35 is positioned a short distance along the face conveyor 15. The drive 39 is mounted on a drive frame 38, which extends parallel to the roadway 12 in the region 37 where the roadway merges with the working 10. The pulley wheels 33 are rotatably mounted on a vertical shaft, and serve to direct the plough drive chain through an angle of 90°. The sprockets 35 and 36 rotate about shafts which are at right-angles to one another and to the axis of the vertical shaft of the pulley wheels 33. The entire plough drive arrangement, consisting of the drive frame 16, the conveyor drive 18, the main plough drive 25, the stable-hole plough drive 39, the drive sprocket 36 and the pulley wheels 33, is attached to the drive frame 38. The drive frame 38 thus forms a support 34 for the drive frame 16, and the entire drive arrangement forms a composite unit.

The two ploughs 19 and 29 are movable along the same guide 26, the main plough 19 being driven by the goaf-side chain 21 and the stable-hole plough 29 being driven by the face-side chain 32. Thus, the main plough 19 can be moved past the face-side idler sprocket 35 associated with the stable-hole plough drive chain 32 and up to the end position shown in FIG. 1. The stable-hole plough 29 can win coal over the end portion of the face 11 between the idler sprocket 35 and the pulley wheels 33, so that the two ploughs have overlapping winning runs. Consequently, coal can be won over the entire length of the face 11. Any coal won by the stable-hole plough 29 as it moves towards the pulley wheels 33 is guided directly on to the roadway conveyor 14.

The stable-hole plough drive chain 32 runs in a pair of vertically-spaced chain ducts 40 and 41 formed in that portion of the plough guide 26 along which the stable-hole plough 29 runs. These ducts 40 and 41 are formed by cut-outs in the otherwise solid guide sections 27. The lower duct 41 is open, at the side, so that the stable-hole plough 29 can be attached to the lower, working run of the drive chain 32 by means of a coupling member 42. Moreover, as best seen in FIG. 1, the idler sprocket 35 is housed within a pair of adjacent guide sections 27, each of which is suitably recessed to define a pocket for the idler sprocket. As the idler sprocket 35 and the stable-hole plough drive chain 32 are housed within the guide 26, there is no hindrance to the main plough 19 moving past the idler sprocket 35 and into the end position shown in FIG. 1.

It will be understood that a corresponding stable-hole plough and associated drive can be provided at the other end of the face 11. In this case, the guide 26 extends the entire length of the face conveyor 15, the drive chains 32 of the two stable-hole ploughs 29 being arranged only in the two end zones of the face conveyor. As shown in FIG. 1, the stable-hole plough 29 can move right up to the junction 37 between the face 11 and the roadway 12. It is, therefore, possible to win coal over the entire length of the face 11, without it being necessary to position the conveyor drive 18 in the roadway 12.

Figure 4:
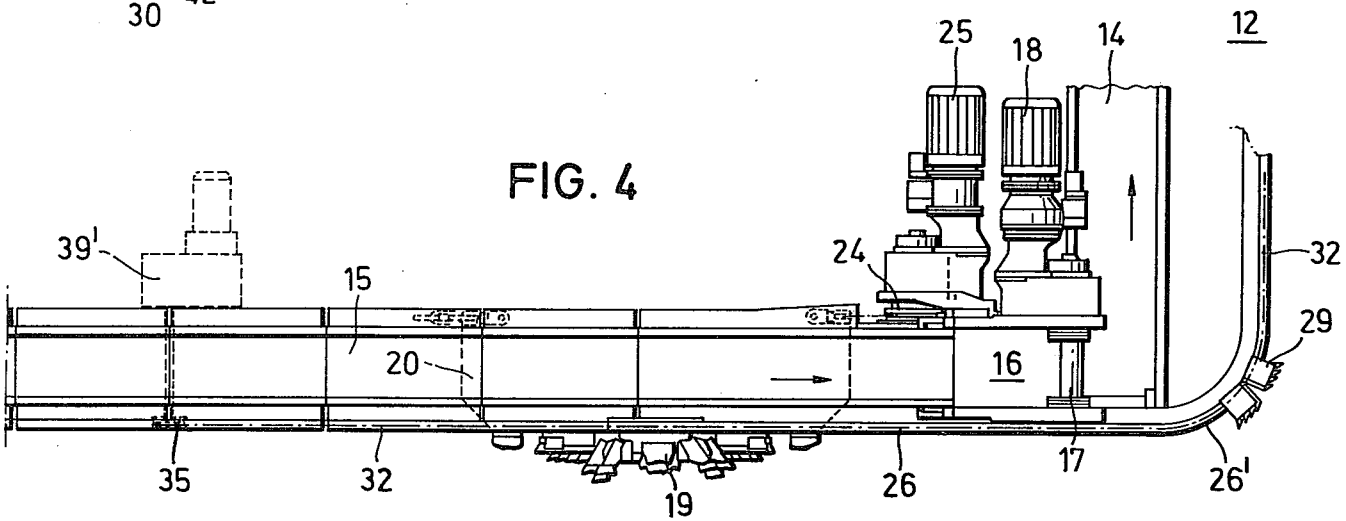
FIG. 4 is a plan view of the second form of installation.

FIG. 4 shows a modified longwall installation, in which the plough guide 26 (constituted by guide sections 27) extends beyond the end of the face conveyor 15 and the drive frame 16. The guide extension 26' curves through 90° and terminates in a portion which runs parallel to the roadway 12. The drive sprocket (not shown but similar to the drive sprocket 36 of the embodiment of FIGS. 1 to 3) is positioned at the end of the working adjacent to the roadway. The drive itself (not shown but similar to the drive 39 of FIGS. 1 to 3) is mounted on a drive frame (not shown but similar to the drive frame 38 of FIGS. 1 to 3) which extends parallel to the roadway 12. Alternatively, the sprocket 35 could be the driven sprocket, in which case a plough drive 39' is attached to goaf-side of the face conveyor 15 as shown in dashed-lines in FIG. 4. In this case, the drive shaft of the drive 39' extends through the face conveyor 15, the conveyor channel sections concerned being suitably apertured between the upper and lower conveying runs to receive this drive shaft. In order to negotiate the curved plough guide extension 26', the stable-hole plough 29 of the FIG. 4 embodiment is a small curved plough.

Figure 2:
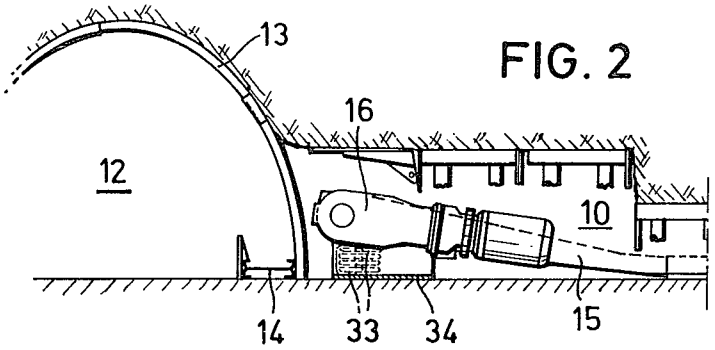
FIG. 2 is a view, looking from the goaf-side, of the installation shown in FIG. 1.

As with the embodiment of FIGS. 1 to 3, a similar stable-hole plough could be provided at the other end of the face conveyor 15 of FIG. 4. It is also possible to provide a stable-hole plough arrangement of the type shown in FIGS. 1 to 3 at one end of a face conveyor, and a stable-hole plough arrangement of the type shown in FIG. 4 at the other end of that face conveyor. In this case, the FIG. 4 type stable-hole plough would be at the auxiliary drive end of the conveyor. A plurality of chain-linked ploughs could also be used instead of the single ploughs illustrated, particularly for the stable-hole ploughs.

Figure 5:
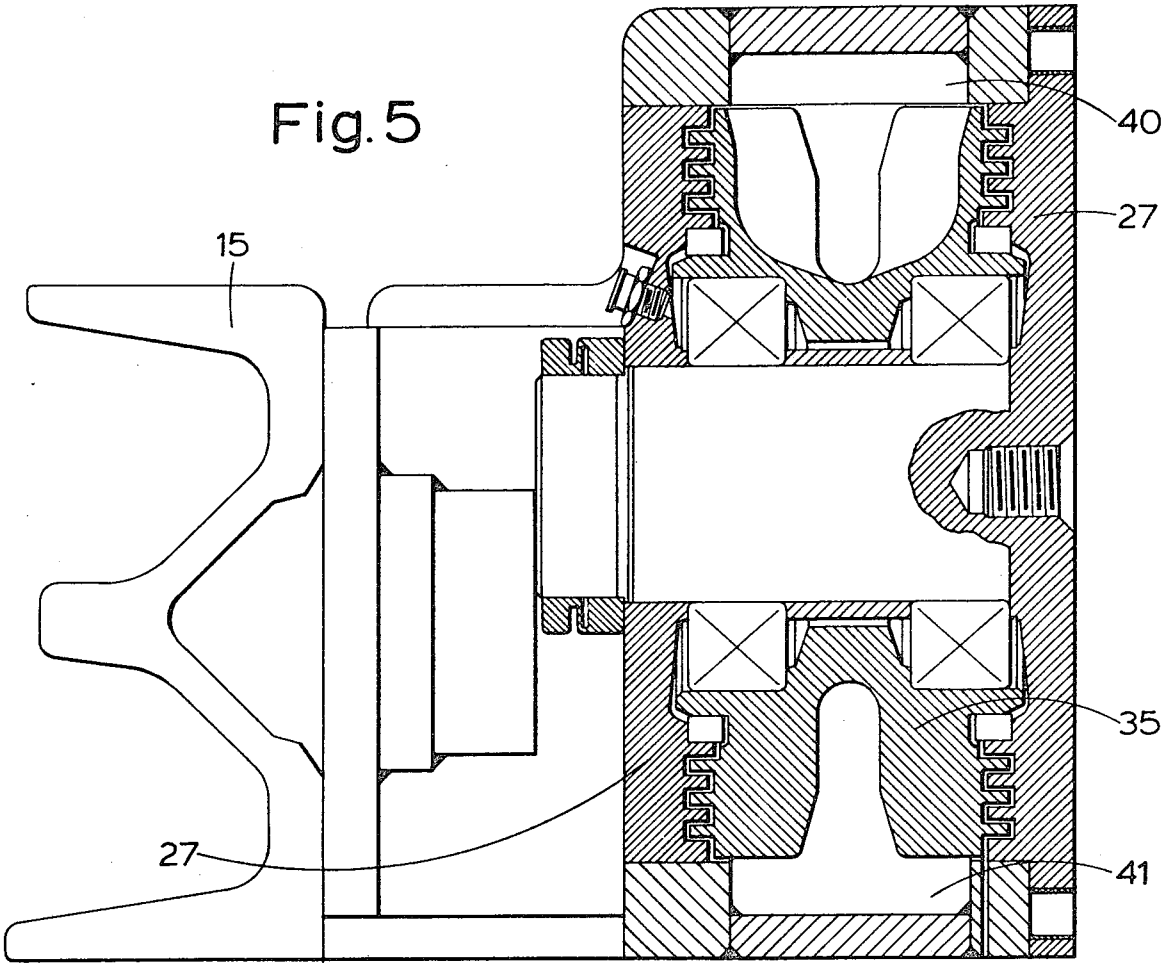
FIG. 5 is a cross-section, on an enlarged scale, taken on the line A—A of FIG. 1.

FIG. 5 shows the sprocket 35 housed within recesses in a pair of adjacent guide sections 27, the recesses merging with the chain ducts 40 and 41.

I claim:

1. A longwall mineral mining installation comprising a longwall conveyor, a guide attached to the face-side of the conveyor, a main plough movable to and fro along the guide, and an auxiliary plough movable to and fro along a portion of the guide adjacent to one end of the conveyor, the auxiliary plough being driven by means of an endless drive chain which passes round two end sprockets, wherein one end sprocket is positioned within the guide at the face-side of the conveyor part way therealong, the other end sprocket is positioned at said one end of the conveyor on the goaf-side thereof, and the drive chain passes round a direction-changing unit positioned at said one end of the conveyor.

2. An installation according to claim 1, wherein the main plough has a sword plate which extends beneath the conveyor and engages a drive chain housed within a chain guide at the goaf-side of the conveyor.

3. An installation according to claim 2, wherein the drive chain of the main plough is powered by a main drive positioned adjacent to said one end of the conveyor.

4. An installation according to claim 3, wherein the conveyor is driven, via drive chain means by means of a conveyor drive positioned adjacent to said one end of the conveyor.

5. An installation according to claim 4, wherein the drive chain of the auxiliary plough is powered by means of an auxiliary drive positioned adjacent to said one end of the conveyor.

6. An installation according to claim 5, wherein the auxiliary drive is off-set towards the goaf-side of the conveyor with respect to the main drive and the conveyor drive.

7. An installation according to claim 5, wherein the auxiliary drive drives said other end sprocket, said one end sprocket being an idler sprocket.

8. An installation according to claim 5, wherein the auxiliary drive drives said one end sprocket said other end sprocket being an idler sprocket.

9. An installation according to claim 5, wherein the main drive, the conveyor drive and the auxiliary drive form a composite unit.

10. An installation according to claim 6, wherein the direction-changing unit is mounted on a support carrying a drive frame situated at said one end of the conveyor.

11. An installation according to claim 10, wherein the main drive and the conveyor drive are attached to the drive frame, and the auxiliary drive is attached to the support.

12. An installation according to claim 1, wherein the direction-changing unit includes a pair of vertically-spaced, pulley wheels rotatably mounted on a common vertical shaft.

13. An installation according to claim 1, wherein the direction-changing unit is mounted on a drive frame situated at said one end of the conveyor.

14. An installation according to claim 1, wherein the direction-changing unit includes a curved extension of the guide.

15. An installation according to claim 1, wherein the guide includes a plurality of guide sections.

16. An installation according to claim 15, wherein the guide sections which constitute said portion of the guide are each provided with a pair of vertically-spaced chain ducts which house the drive chain of the auxiliary plough.

17. An installation according to claim 15, wherein said one end sprocket is housed within a pocket formed in the guide.

18. An installation according to claim 17, wherein the pocket is defined by recesses formed in a pair of adjacent guide sections.

19. An installation according to claim 15, wherein each guide section is a solid plate.

20. An installation according to claim 1, wherein the direction-changing unit directs the drive chain of the auxiliary plough through an angle of 90°.

21. A longwall mineral mining installation comprising a longwall conveyor, a guide attached to the face-side of the conveyor, a main plough movable to and fro along the guide, a respective auxiliary plough movable to and fro along portions of the guide adjacent to each end of the conveyor, each auxiliary plough being driven by means of a respective endless drive chain which passes round two end sprockets, wherein one end sprocket of each auxiliary plough is positioned within the guide at the face-side of the conveyor part way therealong, the other end sprocket of each auxiliary plough is positioned at the adjacent end of the conveyor on the goaf-side thereof, and each drive chain passes round a direction-changing unit positioned at the adjacent end of the conveyor.

22. In a longwall mineral mining installation comprising a longwall conveyor, a guide attached to the face-side of the conveyor, a main plough movable to and fro along the guide, and an auxiliary plough movable to and fro along a portion of the guide adjacent to one end of the conveyor, the auxiliary plough being driven by means of an endless drive chain which passes round two end sprockets, the improvements comprising positioning one end sprocket behind the face-side of the guide part way along the conveyor, positioning the other end sprocket at said one end of the conveyor on the goaf-side thereof, and passing the drive chain round a direction-changing unit positioned at said one end of the conveyor.

* * * * *